United States Patent [19]

Itakura et al.

[11] 4,109,463

[45] Aug. 29, 1978

[54] EXHAUST REACTION CHAMBER FOR INTERNAL COMBUSTION ENGINE

[75] Inventors: Kiyoyuki Itakura, Asaka; Yohji Ishii, Saitama; Satoru Ohata; Masao Watanabe, both of Asaka, all of Japan

[73] Assignee: Honda Giken Kogyo Kabushiki Kaisha, Tokyo, Japan

[21] Appl. No.: 739,182

[22] Filed: Nov. 5, 1976

[30] Foreign Application Priority Data

Nov. 12, 1975 [JP] Japan ..... 50-153027[U]

[51] Int. Cl.[2] ..... F01N 3/10; F02B 19/10

[52] U.S. Cl. ..... 60/282; 123/122 AC

[58] Field of Search ..... 60/282; 123/122 AB, 123/122 AC

[56] References Cited

U.S. PATENT DOCUMENTS

| | | | |
|---|---|---|---|
| 3,505,028 | 4/1970 | Douthit | 60/282 |
| 3,994,271 | 11/1976 | Ishizuya | 60/282 |
| 4,016,846 | 4/1977 | Nakano | 123/122 AB |

*Primary Examiner*—Douglas Hart

*Attorney, Agent, or Firm*—Lyon & Lyon

[57] ABSTRACT

An exhaust reaction chamber for an internal combustion engine has an outer downstream chamber section surrounding and enclosing an inner upstream chamber section which receives exhaust gases from the engine. Intake mixture for the engine is heated by exhaust gases in the outer chamber section. A leak hole is provided in the inner chamber section for accelerating heat transfer to the intake mixture during warmup operation of the engine.

3 Claims, 3 Drawing Figures

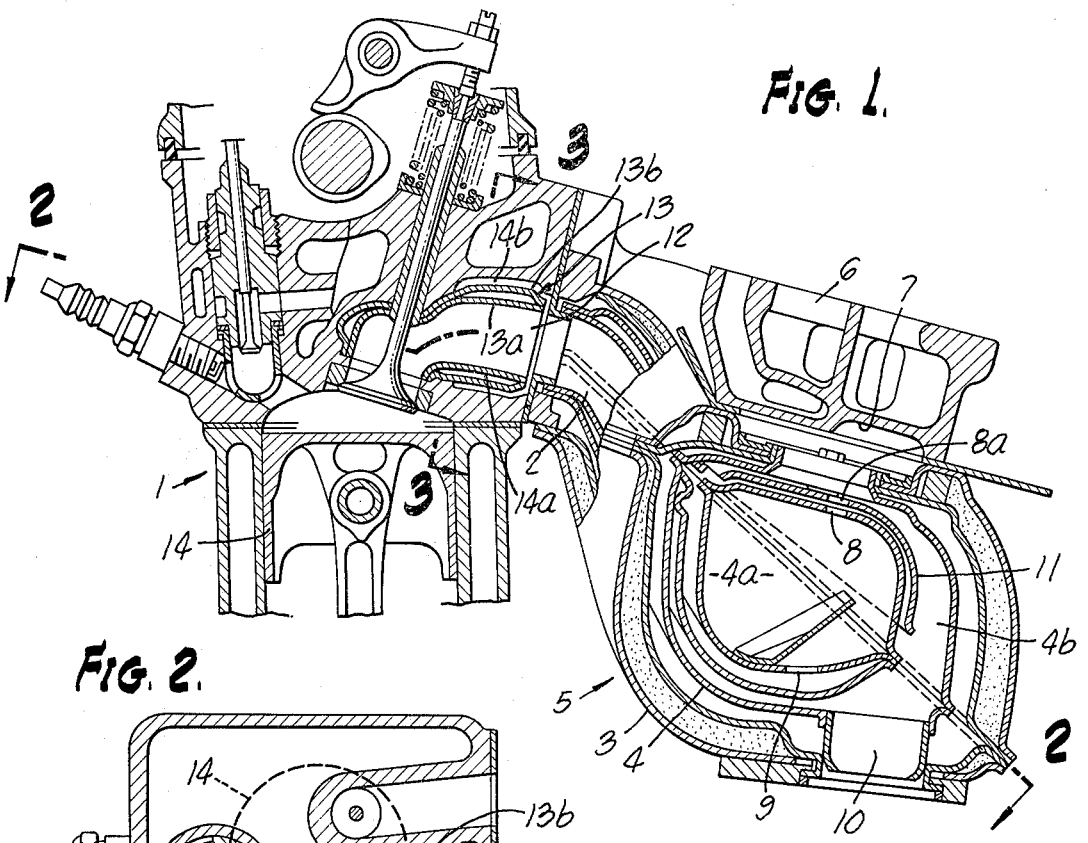
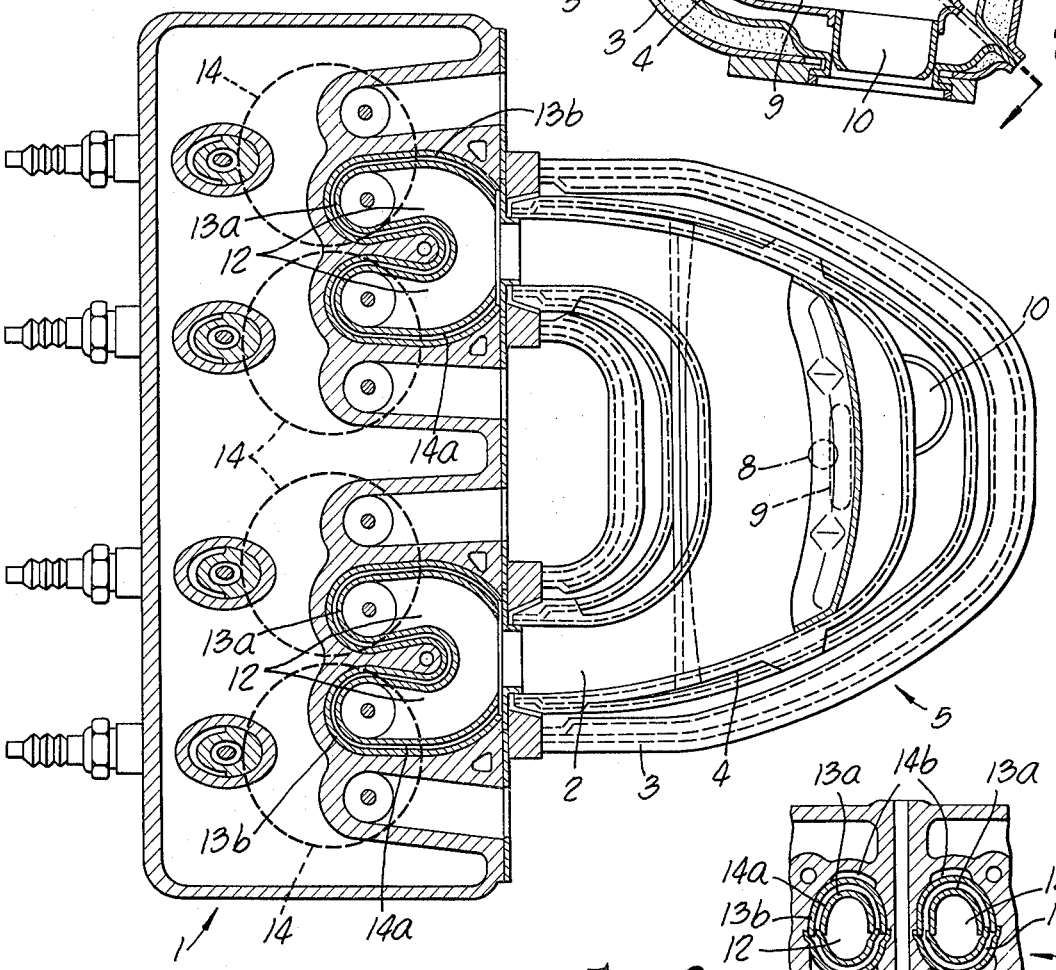
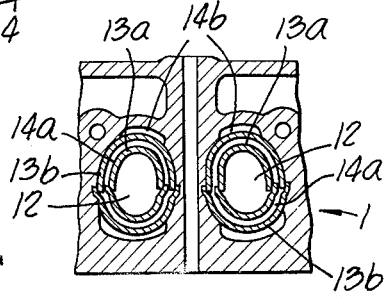
FIG. 3.

EXHAUST REACTION CHAMBER FOR INTERNAL COMBUSTION ENGINE

This invention relates to exhaust reaction chamber devices for internal combustion engines, particularly automobile engines.

In conventional exhaust reaction chamber systems for internal combustion engines, oxidation of HC and CO in the exhaust gas is carried out in a reaction chamber before the gases are discharged into the atmosphere. Such conventional exhaust reaction chambers have employed an inner chamber surrounded and enclosed by an outer chamber, gases in the outer chamber being employed in a heat transfer device for heating the intake mixture supplied to the engine. Such systems have the disadvantage that during the warmup operation of the engine, particularly when the engine is cold, satisfactory heating of the intake mixture cannot be achieved. During such warmup operation, the exhaust gases discharged from the exhaust ports of the engine are relatively low in temperature, but the exhaust gas temperature drops further during the time it travels successively through the upstream inner chamber and the downstream outer chamber of the exhaust reaction chamber. In this relatively low temperature condition of the exhaust gases in the downstream outer chamber, the transfer of heat to the intake mixture is inefficient, resulting in poor mixture combustion in the engine as well as impairing purification of the exhaust gas.

It is therefore an object of this invention to provide an exhaust reaction chamber device for an internal combustion engine, which device is free of such disadvantages and which includes provision for accelerating the heating action for the intake mixture during engine warmup operation.

Other and more detailed objects and advantages will appear hereinafter.

In the drawings:

FIG. 1 is a sectional side elevation showing a preferred embodiment of this invention.

FIG. 2 is a sectional plan view taken substantially on the lines 2—2 as shown in FIG. 1.

FIG. 3 is a sectional detail taken substantially on the lines 3—3 as shown in FIG. 1.

Referring to the drawings, the engine generally designated 1 has exhaust passages 2 which lead to an exhaust reaction chamber generally designated 5. The exhaust reaction chamber 5 includes an outer chamber 3 having a relatively thick peripheral wall and an inner chamber 4 having a relatively thin wall. The exhaust reaction chamber 5 is located beneath the undersurface of an intake passage 6 to form an intake heating section 7. The inner chamber 4 includes an inner chamber section **4*a* on the upstream side and an outer chamber section 4*b* enclosing the periphery thereof and located on the downstream side. The inner chamber section 4*a* is provided with a leak hole 8 leading to the intake heating section 7**.

The inner chamber section **4*a* is connected to the outer chamber section 4*b* through an opening 9 on the downstream side, and the outer chamber section 4*b* is connected to an outside exhaust pipe (not shown) at an opening 10 on the downstream side thereof. In the embodiment shown, a baffle plate 11 is mounted in the outer chamber section 4*b* and follows the contour of the upper portion of the thin wall forming the inner chamber section 4*a*. The baffle plate 11 is also provided with a leak hole 8*a* which is aligned with the leak hole 8**.

Also in the embodiment shown, a port liner 13 is provided in each exhaust port 12 of the engine 1, each liner 13 being of double tubular construction comprising an inner liner **13*a* and an outer liner 13*b*, so as to provide two layers of space 14*a* and 14*b*. One of the spaces 14*a* is provided between the two liners 13*a* and 13*b* and the other layer 14*b* is provided between the outer liner 13*b* and the internal wall of the port 12**, on the periphery thereof.

Also in the embodiment shown, particularly as clearly shown in FIG. 2, the engine 1 has four cylinders arranged in line, and the port liners 13 in the series of exhaust ports 12 are grouped by adjacent pairs, each pair being joined within the engine 1.

In operation, the exhaust gases produced by combustion in the engine 1 pass through the exhaust passage 2 into the inner chamber 4. The exhaust gases are oxidized and purified by reaction while passing successively through the inner chamber section **4*a* on the upstream side and the outer chamber section 4*b* on the downstream side. The exhaust gases in the outer chamber section 4*b* transfer heat to the heating section 7 to heat the mixture in the intake passage 6. Part of the exhaust gases in the inner chamber section 4*a* having relatively high temperature are fed through the leak hole 8, a bypass, to the intake heating section 7. In this way the heating section 7** is caused to heat up rapidly. This is an important advantage, particularly during the warmup operation of the engine; the heating section heats up rapidly to heat the air-fuel mixture in the intake passages.

The leak hole 8 is relatively small in diameter, its cross section area being preferably in the range between 1/25 to 1/60 of the area of the surface of the intake heating section 7. Although part of the exhaust gas leaks through the leak holes 8 and **8*a* after completion of the warmup operation, the amount is relatively small and there is no significant effect on the oxidation reaction in the chamber section 4*a***. Delay in the mixture heating during the warmup operation is largely eliminated, and good intake mixture heating is accomplished which in turn results in good combustion of the intake mixture in the engine. This is accomplished with relatively simple, inexpensive construction.

Having fully described our invention, it is to be understood that we are not to be limited to the details herein set forth but that our invention is of the full scope of the appended claims.

We claim:

1. In an internal combustion engine, the combination of: an exhaust passage, an exhaust gas reaction chamber having an upstream inner chamber section connected to receive exhaust gases from said exhaust passage, said reaction chamber including a downstream outer chamber section surrounding said upstream inner chamber section, said inner chamber section having a discharge opening on its downstream side connecting said chamber sections, said inner chamber section also having a small leak hole in a position remote from said discharge opening, an intake mixture passage, heat exchange means for heating the intake mixture from the hot exhaust gases in the outer chamber section, said leak hole being aligned with the heat exchange means to accelerate heating of the intake mixture by means of exhaust gases ejected therethrough during engine warmup operation.

2. The combination set forth in claim 1 in which said leak hole has a cross sectional area of from 1/25 to 1/60 of the effective area of said heat exchange means.

3. The combination set forth in claim 1 in which a baffle member in said outer chamber section is disposed between the heat exchange means and the inner chamber section and is also provided with a small leak hole, said small leak holes being disposed in alignment.

* * * * *